US007492246B2

(12) United States Patent
Chang

(10) Patent No.: US 7,492,246 B2
(45) Date of Patent: Feb. 17, 2009

(54) WINDING STRUCTURE OF TRANSFORMER

(75) Inventor: Yu-Yuan Chang, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 100 days.

(21) Appl. No.: 11/797,182

(22) Filed: May 1, 2007

(65) Prior Publication Data

US 2008/0272874 A1 Nov. 6, 2008

(51) Int. Cl.
*H01F 27/29* (2006.01)

(52) U.S. Cl. ..... 336/192

(58) Field of Classification Search ..... 336/65, 336/83, 180–184, 192, 200, 232, 220–223
See application file for complete search history.

(56) References Cited

U.S. PATENT DOCUMENTS 6,114,932 A * 9/2000 Wester et al. ..... 336/65
7,023,314 B2 * 4/2006 Tolle et al. ..... 336/192
2008/0088401 A1 * 4/2008 Wei ..... 336/182
2008/0211613 A1 * 9/2008 Lin et al. ..... 336/83

FOREIGN PATENT DOCUMENTS

TW 242839 9/2004

* cited by examiner

*Primary Examiner*—Tuyen T. Nguyen
(74) *Attorney, Agent, or Firm*—Muncy, Geissler, Olds & Lowe, PLLC

(57) ABSTRACT

The present invention discloses that a primary and a secondary winding coil are respectively wound around the core and are separated by an insulating layer; and the secondary winding coil has a winding portion wound around the core through at least a circle to define two winding terminals, wherein each winding terminal of the winding portion is connected with an extending section extended to the outside of the transformer and is connected with an electricity connecting section at the rear end thereof. The electricity connecting section has plural pins electrically welded on a circuit board, thereby the extending section that is connected with a rectification switch and increases the contact areas with the air for achieving a heat-dispersing effect and the electricity connecting section are crossing connected between the secondary winding coil and the circuit board to save the space on the circuit board for arranging the secondary winding coil.

13 Claims, 6 Drawing Sheets

WINDING STRUCTURE OF TRANSFORMER

FIELD OF THE INVENTION

The present invention is related to a winding structure of a transformer, wherein the secondary winding coil of the transformer is connected with an extending section and an electricity connecting section extended toward an opposite direction to the transformer for achieving a crossing conduction.

BACKGROUND OF THE INVENTION

Generally, a transformer includes a frame, a pair of assembled cores, and a primary and a secondary winding coils wound on the frame, wherein the frame has a longitudinal through hole for passing through the cores, the frame also has a winding area outside the through hole for winding leading wires so as to form the primary winding coil and the second winding coil which are separated by an insulating layer and whose winding terminals are respectively wound on the frame. As shown in R. O. C. Patent No. M242839, entitled "Improved Transformer Structure", it includes a main body, several insulating pieces, a housing and primary and secondary winding coils wound on the main body. Nowadays, the greatest power output of a power supplier can easily achieve one thousand watts and more, which is far exceeding the conventional expect. Therefore, since the power is increased, the size of the element is also enlarged. However, all the elements have to be welded on a circuit board, which has a universal standard in general power supplier, so that the increased power causes the inner space of the power supplier more and more crowded. Furthermore, the current output of the transformer is achieved by utilizing copper foil to electrically connect to the elements on the circuit board, as shown in FIG. 1, in which the pins of the conventional transformer are connected to a capacitor, an IC or other electronic elements through the copper foil for outputting electricity. Since the current conducting capability of a copper foil with an identical thickness is proportion to the width thereof, the higher the output current, the wider the copper foil. However, the copper foils are arranged on the circuit board, so that the more the copper foils, the more space the circuit board has to be left for arranging, thereby causing the arranging space of the circuit board to become less arid less. As shown in FIG. 1, a circuit board 4 has, mounted therein, plural rectification switches 5, ICs 6, or electronic elements, such as, capacitors 71, resistors 72, and diodes 73. Since the conventional transformer 1 needs to arrange several strips of copper foils 2 for outputting, a lot of space will be occupied so as to narrow the available space and complicate the element arrangement. Furthermore, in the conventional transformer 1, the copper winding coil may have a greater loss as the high frequency current passes through, that's because the resistance of the copper wire makes the current only to flow at the surface of the copper wire, so that the utility rate of copper wire reduces, in other words, the copper wire has a greater resistance under high frequency current. Another problem is heat-dispersing. The frame wound by the copper wire is sleeved on the cores, so that the greenhouse effect might be produced, thereby blocking the outward heat-dispersing. Consequently, when mounting the transformer, it needs to utilize the wire arranging space well or the mounting and welding manner has to be improved.

SUMMARY OF THE INVENTION

Therefore, since the conventional transformer structure might meet the problem of insufficient space as mounting in the power supplier, the object of the present invention is to provide an improved transformer structure for achieving a better space arrangement.

The present invention is related to a winding structure of a transformer, which is constructed by at least a core, at least a primary winding coil and a secondary winding coil, wherein the primary winding coil and the secondary winding coil are respectively wound around the core and are separated by an insulating layer; and the secondary winding coil has a winding portion wound around the core through at least a circle, so as to define two winding terminals, wherein each winding terminal of the winding portion is connected with an extending section, which is extended to the outside of the transformer and is connected with an electricity connecting section at the rear end thereof, and the electricity connecting section has plural pins electrically welded on a circuit board, thereby the extending section and the electricity connecting section are crossing connected between the secondary winding coil and the circuit board so as to save the space on the circuit board for arranging the secondary winding coil. Here, the extending section also can be connected with at least a rectification switch. Besides, the extending section can further increase the connect area with the air for achieving a heat-dispersing effect.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
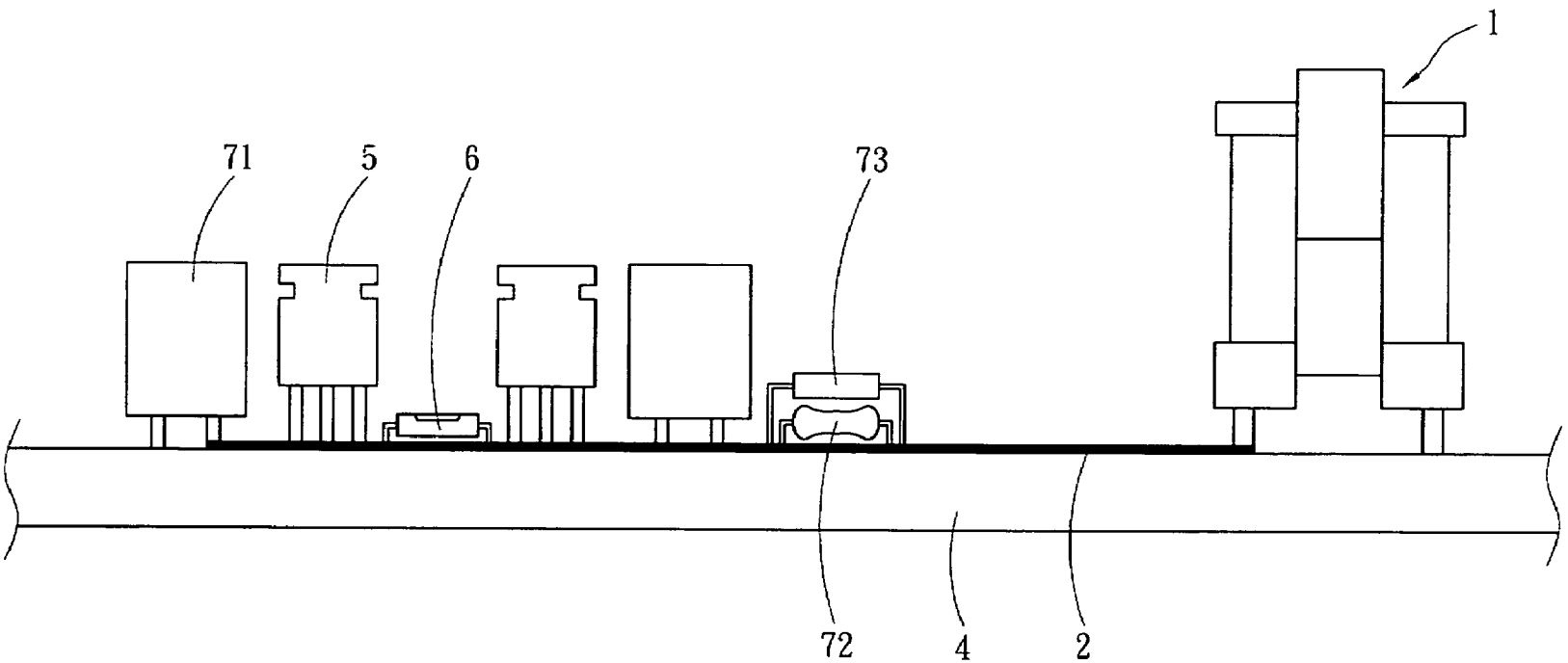
Fig. 1 PRIOR ART
FIG. 1 is a schematic view showing a conventional transformer.
Figure 2A:
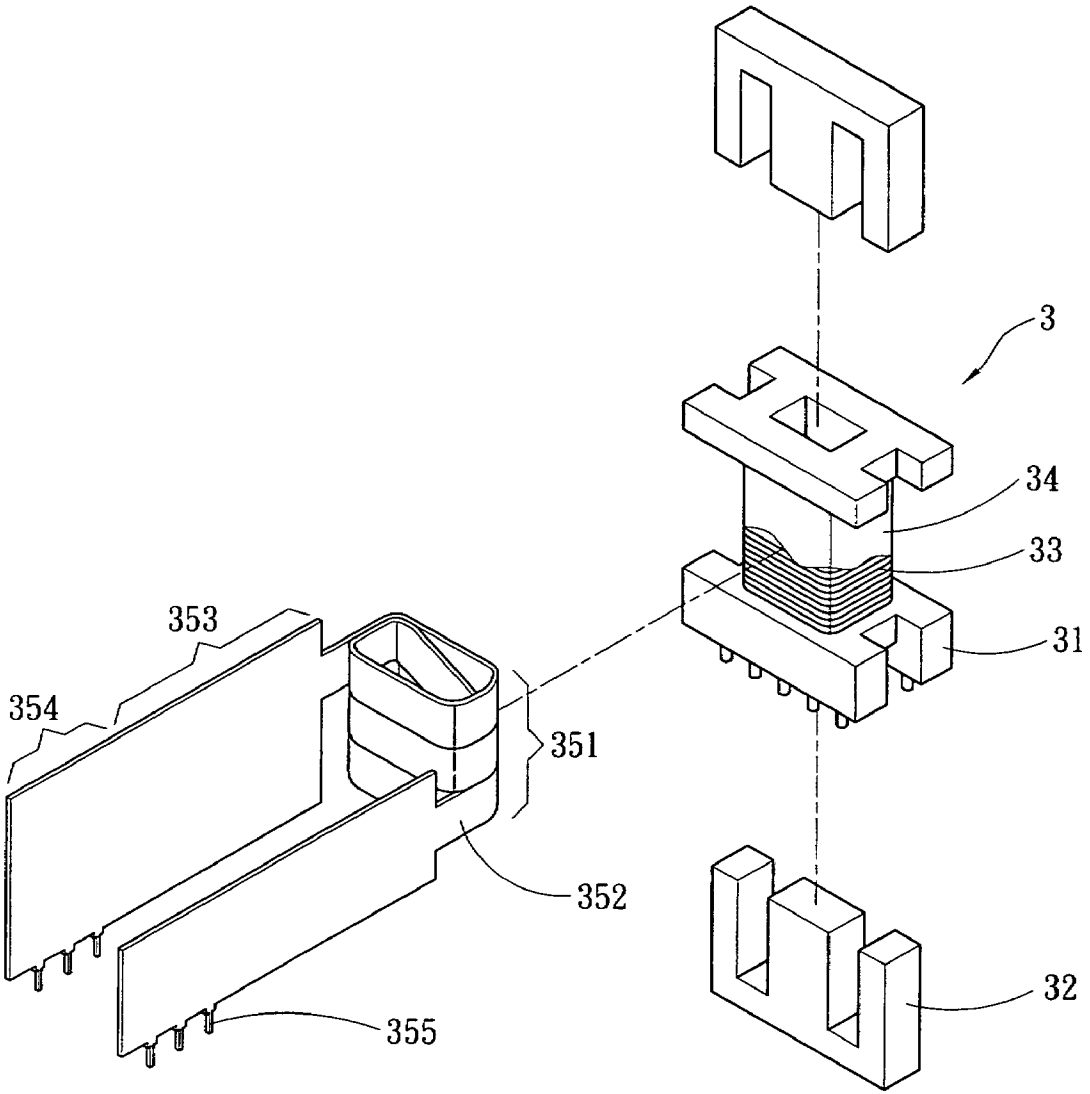
FIG. 2A is a decomposition drawing showing an embodiment of the present invention.
Figure 2B:
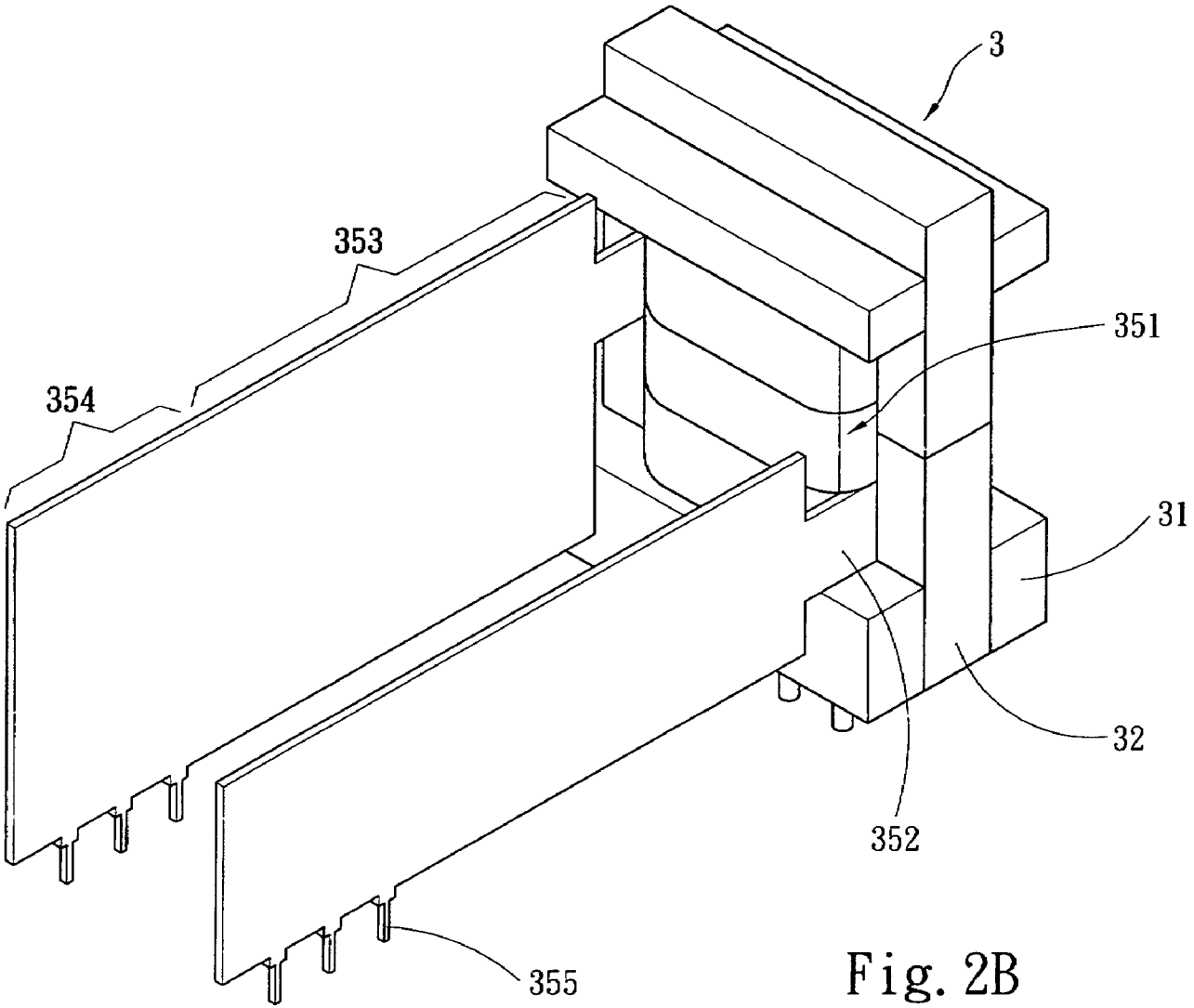
FIG. 2B is a three-dimensional drawing showing an embodiment of the present invention.

Please refer to FIG. 2A and FIG. 2B, which are respectively a decomposition drawing and a three-dimensional drawing showing a preferred embodiment according to the present invention. The present invention is related to a winding structure used for a transformer which includes at least a core 32, a primary winding coil and a secondary winding coil, wherein the winding coils are magnetically coupled through the core 32 to form a transformer 3. Moreover, a frame 31 is further included between the core 32 and the primary and the secondary winding coils. In this embodiment, a coil 33 is used as the primary winding coil, and the coil 33 is coated by an insulating layer 34. Then, the secondary winding coil is defined to have a winding portion 351 wound around the core 32, and the two ends of the winding portion 351 respectively are defined to be a winding terminal 352. Here, the winding terminals 352 are respectively connected with an extending section 353, which is extended from the winding terminal 352 of the winding portion 351 in a parallel or bending manner and is toward a direction opposite to the transformer 3. In addition, an electricity-connecting section 354 is further connected to the rear end of the extending section 353 in a parallel or bending manner for extending to electrical connecting positions of a circuit board 4, wherein the electricity-connecting section 354 has plural pins 355 for connecting to elements for outputting.

Figure 3:
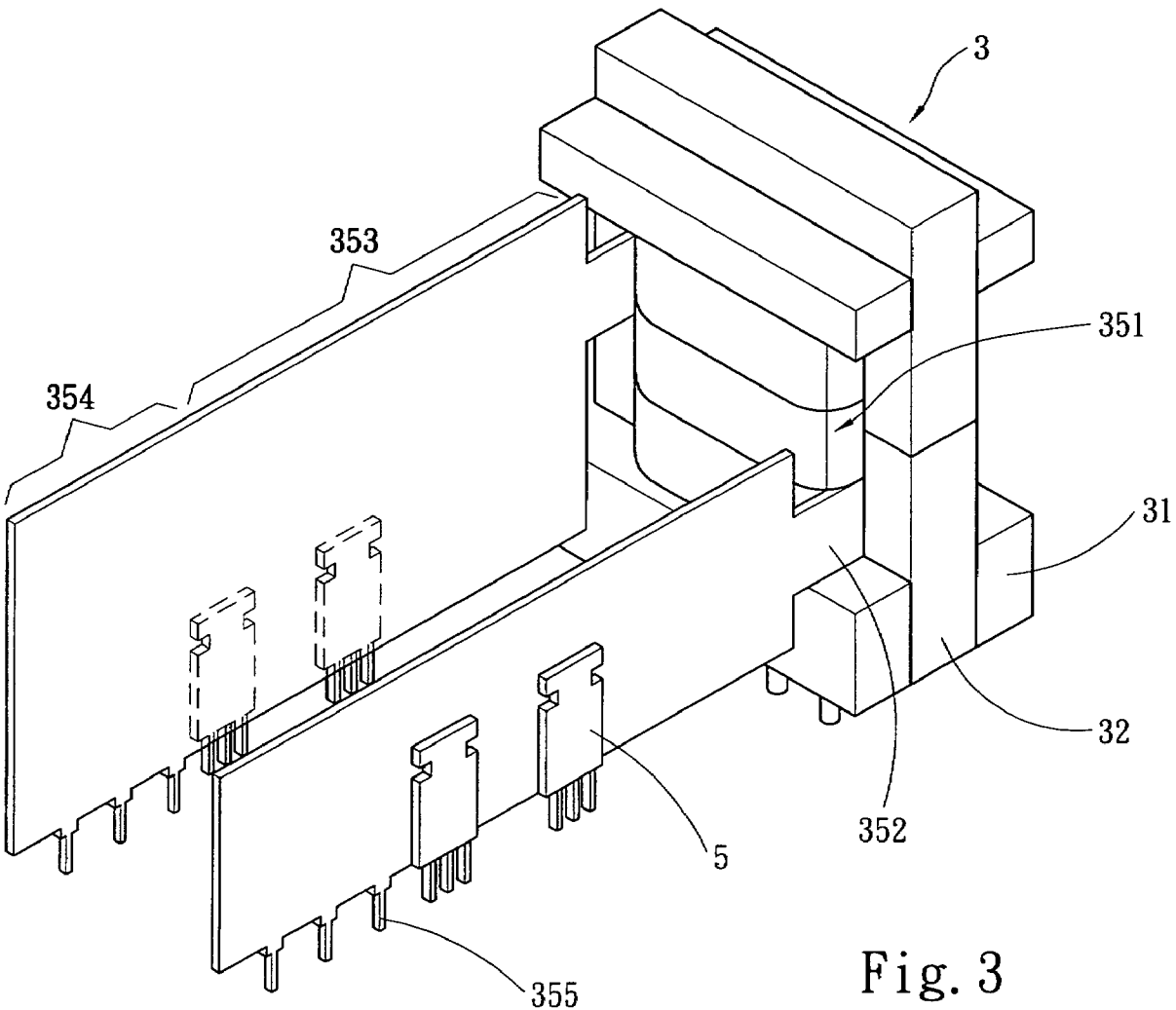
FIG. 3 shows an example of the present invention.
Figure 4:
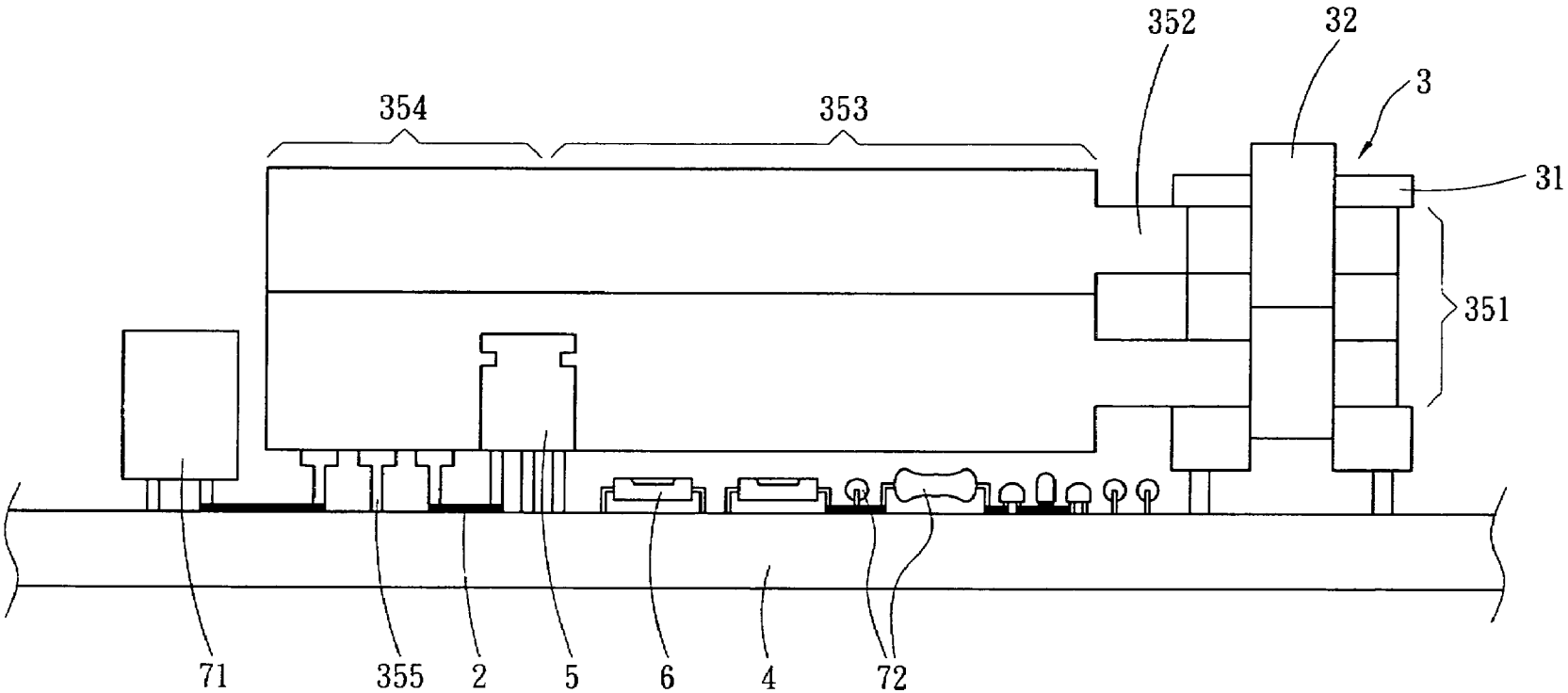
FIG. 4 shows another example of the present invention.

Please refer to FIG. 3 and FIG. 4, which respectively shows a first example and a second example of the present invention. Since the extending section 353 of the secondary winding coil is extended toward the opposite direction to the transformer 3, the contact area with the air is bigger, so that the heat from the transformer 3 can be conducted and dispersed to the air through contact conduction. Moreover, at least one surface of the extending section 353 or the electricity connecting section 354 is defined as a heat-dispersing surface for mounting the electronic element, which is electrically connected to the circuit board 4. Here, the electronic element can be plural rectification switches 5, so as to assist the rectification switches 5 in lowering temperature. Furthermore, through utilizing plural pins 355, the electricity connecting section 354 can use a shorter copper foil 2 to conduct with the rectification switches 5. The electricity connecting section 354 can be extended to the neighborhood of the electronic element, such as plural capacitors 71 and rectification switches 5, and utilize plural pins 355 to electrically connect with the circuit board 4, so that the pins 355 only need shorter cooper foil 2 to electrically connect with plural capacitors or other electronic elements, thereby the utilized amount of copper foil can be reduced for saving the occupied area around the transformer 3, and thus, more electronic elements can be mounted on the surface areas of the transformer 3. Since the circuit board 4 is less covered by copper foil 2, less current passes through the circuit board 4, thereby reducing the working temperature of the circuit board 4. In addition, the secondary winding coil will have a lower resistance when high-frequency current passes therethrough, so that the loss can be reduced and also the working temperature.

Figure 5:
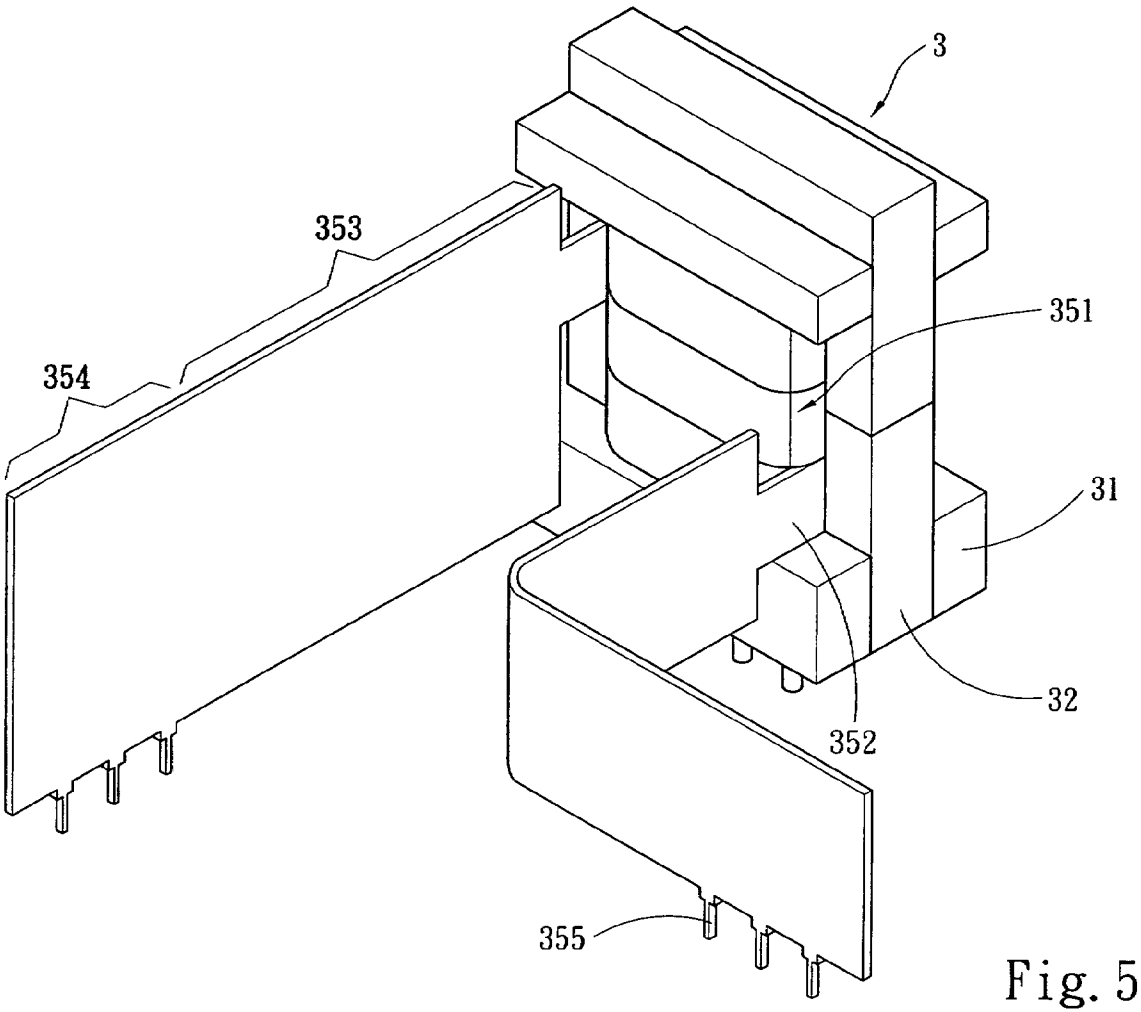
FIG. 5 shows another embodiment of the present invention.

Alternatively, only one of the two winding terminals 352, as described above, is extended to have the extending section 353, which can be bent through an angle to locate at one particular position above the circuit board 4, such that the electricity can be outputted to any position of the circuit board 4. As shown in FIG. 5, both the extending section 353 and the electricity connecting section 354 can be bent, and the winding terminal 352 also can be connected with more than one extending section 353 for connecting to more elements.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A winding structure of a transformer having at least a core, at least a primary winding coil and a secondary winding coil, wherein the primary winding coil and the secondary winding coil are magnetically coupled through the core, and the secondary winding coil has a winding portion wound around the core, the secondary winding coil further comprises:

at least an extending section, connected to a winding terminal of the winding portion, extended toward an opposite direction to the transformer, and connected with an electricity connecting section, which has at least a pin electrically connected with a circuit board.

2. The winding structure of transformer as claimed in claim 1, wherein the extending section is extended from the winding terminal of the winding portion in a bending manner.

3. The winding structure of transformer as claimed in claim 1, wherein the extending section is extended from the winding terminal of the winding portion in a parallel manner.

4. The winding structure of transformer as claimed in claim 1, wherein the electricity connecting section is parallel extended from the extending section to an electrical connecting position on the circuit board.

5. The winding structure of transformer as claimed in claim 4, wherein the extending section is extended from the winding terminal of the winding portion in a bending manner.

6. The winding structure of transformer as claimed in claim 4, wherein the extending section is extended from the winding terminal of the winding portion in a parallel manner.

7. The winding structure of transformer as claimed in claim 1, wherein the electricity connecting section is bent extended from the extending section to an electrical connecting position on the circuit board.

8. The winding structure of transformer as claimed in claim 7, wherein the extending section is extended from the winding terminal of the winding portion in a bending manner.

9. The winding structure of transformer as claimed in claim 7, wherein the extending section is extended from the winding terminal of the winding portion in a parallel manner.

10. The winding structure of transformer as claimed in claim 1, wherein at least one surface of the extending section is a heat-dispersing surface for mounting an electronic element, which is electrically connected to the circuit board.

11. The winding structure of transformer as claimed in claim 10, wherein the electronic element is a rectification switch.

12. The winding structure of transformer as claimed in claim 1, wherein at least one surface of the electricity connecting section is a heat-dispersing surface for mounting an electronic element, which is electrically connected to the circuit board.

13. The winding structure of transformer as claimed in claim 12, wherein the electronic element is a rectification switch.

* * * * *